US005798472A

United States Patent [19]

Shigenaga

[11] Patent Number: 5,798,472

[45] Date of Patent: Aug. 25, 1998

[54] DRUM BEATER FOR BASS DRUM EQUIPPED WITH EXACTLY ADJUSTABLE RETURN SPRING REGULATOR

[75] Inventor: Fumihiro Shigenaga, Shizuoka, Japan

[73] Assignee: Yamaha Corporation, Shizuoka-ken, Japan

[21] Appl. No.: 651,838

[22] Filed: May 21, 1996

[30] Foreign Application Priority Data

May 22, 1995 [JP] Japan ..... 7-122283

[51] Int. Cl.[6] ..... G10D 13/02

[52] U.S. Cl. ..... 84/422.1; 84/458; 84/413

[58] Field of Search ..... 84/422.1, 422.2, 84/458, 413

[56] References Cited

U.S. PATENT DOCUMENTS 4,903,569 2/1990 Kurosaki ..... 84/413

5,365,824 11/1994 Hoshino ..... 84/422.1

FOREIGN PATENT DOCUMENTS 55-45433 10/1980 Japan .

58-43035 9/1983 Japan .

6-73795 10/1994 Japan .

*Primary Examiner*—Cassandra C. Spyrou

*Attorney, Agent, or Firm*—Ostrolenk, Faber, Gerb & Soffen, LLP

[57] ABSTRACT

A return spring regulator incorporated in a drum beater has a regulating nut rotatable with respect to a frame and a regulating bolt screwed into the regulating nut, and a player regulates the tension of a coil spring stretched between an arm member fixed to a rotatable shaft and the regulating bolt by simply rotating the regulating nut.

2 Claims, 6 Drawing Sheets

DRUM BEATER FOR BASS DRUM EQUIPPED WITH EXACTLY ADJUSTABLE RETURN SPRING REGULATOR

FIELD OF THE INVENTION

This invention relates to a drum beater for a bass drum and, more particularly, to a drum beater for a bass drum equipped with an exactly adjustable return spring regulator.

DESCRIPTION OF THE RELATED ART

A player beats the bass drum with a drum beater. The drum beater largely comprises a foot pedal assembly, a beater driven for rotation by the foot pedal assembly and a righting moment generator for imparting a righting moment to the beater. A typical example of the drum beater is disclosed in Japanese Utility Model Publication of Examined Application Nos. 55-45433 and 58-43035, and FIG. 1 illustrates the prior art drum beater.

Referring to FIG. 1 of the drawings, the prior art drum beater comprises a foot pedal assembly 1, a beater 2 and a righting moment generator 3. The foot pedal assembly 1 includes a frame 1*a* standing on a floor 4, a shaft member 1*b* rotatably supported by the frame 1*a*, a foot board 1*c* turnable with respect to the frame 1*a*, a sprocket 1*d* fixed to the shaft member 1*b* and a chain 1*e* engaged between the foot pedal 1*c* and the sprocket 1*e*. The beater 2 includes a hub 2*a* fixed to the shaft member 1*b* and a mallet 2*b* projecting from the hub 2*a*, and the mallet 2*b* is rotated together with the shaft member 1*b*.

When a player steps on the foot board 1*c*, the foot board 1*c* turns, and pulls the chain 1*e*. The chain 1e rotates the sprocket 1*d* and, accordingly, the shaft member 1*b*. The mallet 2*b* is rotated, and strikes the skin of the bass drum (not shown).

The righting moment generator 3 imparts a righting moment to the shaft member 1*b*, and causes the beater 2 and the foot board 1*c* to return to respective home positions upon releasing the foot pedal 1*c*. In detail, the righting moment generator 3 includes an arm member 3*a* fixed to the shaft member 1*b* and an anchor member 3*b* screwed into the leading end portion of the arm member 3*a*, and the arm member 3*a* is rotated together with the shaft member 1*b*. When the foot board 1*c* stays at the home position, the arm member 3*a* downwardly projects from the shaft member 1*b*, and the anchor member 3*b* is close to the floor 4. The sprocket 1*d* rotates the arm member 3*a* together with the shaft member 1*b*, and the anchor member is spaced from the floor 4.

The righting moment generator 3 further includes a regulating bolt 3*c*, a regulating nut 3*d*, a lock nut 3*e* and a coil spring 3*f* stretched between the anchor member 3*b* and the regulating bolt 3*c*. The regulating bolt 3*c*, the regulating nut 3*d* and the lock nut 3*e* form in combination a return string regulator. The regulating bolt 3*d* loosely passes through a hole formed in a projection 1*f* of the frame 1*a*, and is screwed into the regulating nut 3*d* and the lock nut 3*e*. The projection 1*f* is sandwiched between the regulating nut 3*d* and the lock nut 3*e*, and the regulating bolt 3*d* is fixed to the frame 1*a*.

If a player does not exert the force on the foot board 1*c*, the coil spring 3*f* minimizes the distance between the projection 1*f* and the anchor member 3*b*, and downwardly directs the anchor member 3*b*. The anchor member 3*b* exerts the righting moment on the shaft member 1*b*, and holds the mallet 2*b* and the foot board 1*c* at the home positions.

When the player steps on the foot board 1*c*, the foot board 1*c* pulls the chain 1*e* and, accordingly, the sprocket 1*e*, and the sprocket 1*d* exerts a moment on the shaft member 1*b* against the righting moment. As described hereinbeore, the shaft member 1*b* is rotated, and the beater 2 strikes the skin of the bass drum. The arm member 3*a* is also rotated, and spaces the anchor member 3*b* from the floor 4. The anchor member 3*b* increases the distance from the projection 1*f*, and stretches the coil spring 3*f*. The coil spring 3*f* increases the righting moment. Therefore, when the player releases the foot board 1*c*, the righting moment causes the beater 2 and the foot board 1*c* to return to the home positions.

The righting moment is regulable as follows. If a player wants to increase the righting moment, he loosens the lock nut 3*e*, and tightens the regulating nut 3*d* so as to pull down the regulating bolt 3*c* against the elastic force of the coil spring 3*f*. When the player appropriately adjusts the righting moment, the lock nut 3*e* is tightened, and the regulating nut 3*d* and the lock nut 3*e* holds the regulating bolt 3*c* at the adjusted position. Then, the coil spring 3*f* is further stretched, and increases the righting moment. The increased righting moment causes the player to feel the foot board heavier, and the beater 2 and the foot board quickly return to the home positions.

On the other hand, if a player wants to decrease the righting moment, the player loosens the regulating nut 3*d*, and the elastic force of the coil spring 3*f* pull up the regulating bolt 3*c*. When the righting moment is appropriately regulated, the player tightens the lock nut 3*e* so as to hold the regulating bolt 3*c* at the appropriate position. The decreased righting moment causes the player to feel the foot board light, and the beater 2 and the foot board 1*c* slowly return to the home positions.

The prior art drum beater thus arranged encounters a problem in complicated regulating work. As described hereinbefore, the player needs to individually turn the regulating nut 3*d* and the lock nut 3*e* so as to adjust the righting moment, and such a double loosening/tightening work is complicated for the player. Especially, when the player loosens the lock nut 3*e*, he needs to oppositely exert moments on the lock nut 3*e* and the regulating nut 3*d* so as to prevent the regulating nut 3*d* and the regulating bolt 3*c* from turn together. If the lock nut was excessively tightened, he needs tools, and the loosening work is not easy.

In order to solve the problem inherent in the prior art beater, Japanese Utility Model Publication of Unexamined Application No. 6-73795 discloses another prior art beater shown in FIG. 2. The prior art drum beater disclosed in the Japanese Utility Model Publication also comprises a foot pedal assembly 5, a beater 6 and a righting force generator 7, and description is focused on the righting moment generator 7.

The righting moment generator 7 includes an arm member 7*a*, a regulating bolt 7*b*, a coil spring 7*c* stretched between the arm member 7*a* and the regulating bolt 7*b*, a regulating nut 7*c*, a lock nut 7*d* and a detent 7*e*. The regulating bolt 7*b*,the regulating nut 7*c*, the lock nut 7*d* and the detent 7*e* as a whole constitute a return spring regulator. The particular feature of the return spring regulator is directed to the detent 7*e*, and description is focused on the structure of the detent 7*e*.

The detent 7*e* includes a flat surface 7*f* formed in the regulating bolt 7*b*, an attachment 7*g* attached to a frame of the foot pedal assembly 5 and a projection 7*h* fixed to the regulating nut 7*c*. The attachment 7*g* has an upper plate 7*ga* and a lower plate 7*gb*, and a hollow space is defined between the upper plate 7*ga* and the lower plate 7*gb*.

A small hole 7*gc* is formed in the upper plate 7*ga*, and is shaped in a D-letter configuration. The regulating bolt 7*b* has a D-letter cross-section similar to the Dletter configuration of the small hole 7*gc*, and passes through the small hole 7*gc*. However, the flat surface 7*f* does not allow the regulating bolt 7*f* to turn in the small hole 7*gc*.

On the other hand, a large hole 7*gd* is formed in the lower plate 7*gb*, and is shaped into a generally triangle configuration. The projection 7*h* has a generally triangle configuration similar to the generally triangle configuration of the large hole. Although the projection 7*h* is insertable into the large hole, the generally triangle configuration does not allow the projection 7*h* to turn in the large hole 7*gd*.

When the drum beater is assembled, the attachment 7*g* is fixed to the frame, and the regulating bolt 7*b* downwardly projects from the large hole 7*gd*. The regulating nut 7*c* turns around the regulating bolt 7*b*, and the projection 7*h* is inserted into the large hole 7*gd*. The lock nut 7*d* is tightened, and the lock nut 7*d* and the regulating nut 7*c* hold the bolts in its appropriate position. The coil spring 7*c* exerts a righting moment on the shaft member 5*a*.

If a player wants to increase the righting moment, he loosens the lock nut 7*d*, and pulls down the regulating nut 7*c* so as to take out the projection 7*h* from the large hole 7*gd*. He turns the regulating nut 7*c*, and pulls down the regulating bolt 7*b*. The flat surface 7*f* and the small hole 7*gc* do not allow the regulating bolt 7*b* to turn with respect to the attachment 7*g*. When the righting moment is regulated, he adopts the projection 7*h* to the large hole 7*gd*, and releases the regulating nut 7*c*. The coil spring 7*c* pulls up the regulating bolt 7*b* and the regulating nut 7*c*, and the large hole 7*gd* snugly receives the projection 7*h*. The lock nut 7*d* is tightened, and the attachment 7*g* is sandwiched between the lock nut 7*d* and the regulating nut 7*c*, again.

On the other hand, if a player wants to decrease the righting moment, the player slightly loosens the lock nut 7*d*, and takes out the projection 7*h* from the large hole 7*gd*. He turns the regulating nut 7*c* so as to move the regulating nut 7*c* in the direction toward the lowest end of the regulating bolt 7*b*. The flat surface 7*f* and the small hole 7*gc* do not allow the regulating bolt 7*b* to turn in the small hole 7*gc*. The coil spring 7*c* pulls up the regulating bolt 7*b*. When the righting moment is regulated, he adopts the projection 7*h* to the large hole 7*gd*, and releases the regulating nut 7*c*. Then, the coil spring 7*c* pulls up the regulating bolt 7*b*, and the large hole 7*gd* receives the projection 7*h*. He tightens the lock nut 7*d*, and the attachment 7*g* is sandwiched between the lock nut 7*d* and the regulating nut 7*c*, again.

The flat surface 7*f* and the small hole 7*gc* prevents the regulating bolt 7*b* from undesirable turn during the regulating work. However, the return spring regulator is expensive because of the flat surface 7*f*, the small hole 7*gc*, the large hole 7*gd* and the projection 7*h*. The flat surface 7*f* decreases the mechanical strength of the regulating bolt 7*b*. Moreover, even through the player regulates the righting moment by turning the regulating nut 7*c*, the righting moment is undesirably decreased when the projection 7*h* is received into the large hole 7*gd*.

SUMMARY OF THE INVENTION

It is therefore an important object of the present invention to provide a drum beater a return spring regulator of which is simple and low in production cost and allows a player to exactly adjust a righting moment.

In accordance with the present invention, there is provided a drum beater for a drum having a skin stretched over a shell, comprising: a foot pedal assembly including a rotatable shaft and a foot board where a player steps on for rotating the rotatable shaft from a home position toward the skin; a beater connected to the rotatable shaft for beating the skin; and a righting moment generating means connected to the rotatable shaft for urging the beater toward the home position, and including an arm member fixed to the rotatable shaft, a spring member connected at one end to the arm member and generating an elastic force for imparting a righting moment to the rotatable shaft and a spring regulator connected to the other end of the spring member so as to change the elastic force exerted to the arm member, the spring regulator including a regulating nut member having an inner threaded portion, a first portion rotatably inserted into a through-hole formed in the foot pedal assembly and a second portion larger in the maximum dimension of a cross section than the through-hole, a regulating bolt member connected to the other end of the spring member and having an outer threaded portion engaged with the inner threaded portion so as to be screwed into or out from the first portion and a clamper for preventing the first portion from a rotation in the through-hole.

BRIEF DESCRIPTION OF THE DRAWINGS

The features and advantages of the beater for a bass drum according to the present invention will be more clearly understood from the following description taken in conjunction with the accompanying drawings in which.

DESCRIPTION OF THE PREFERRED EMBODIMENT

Figure 1:
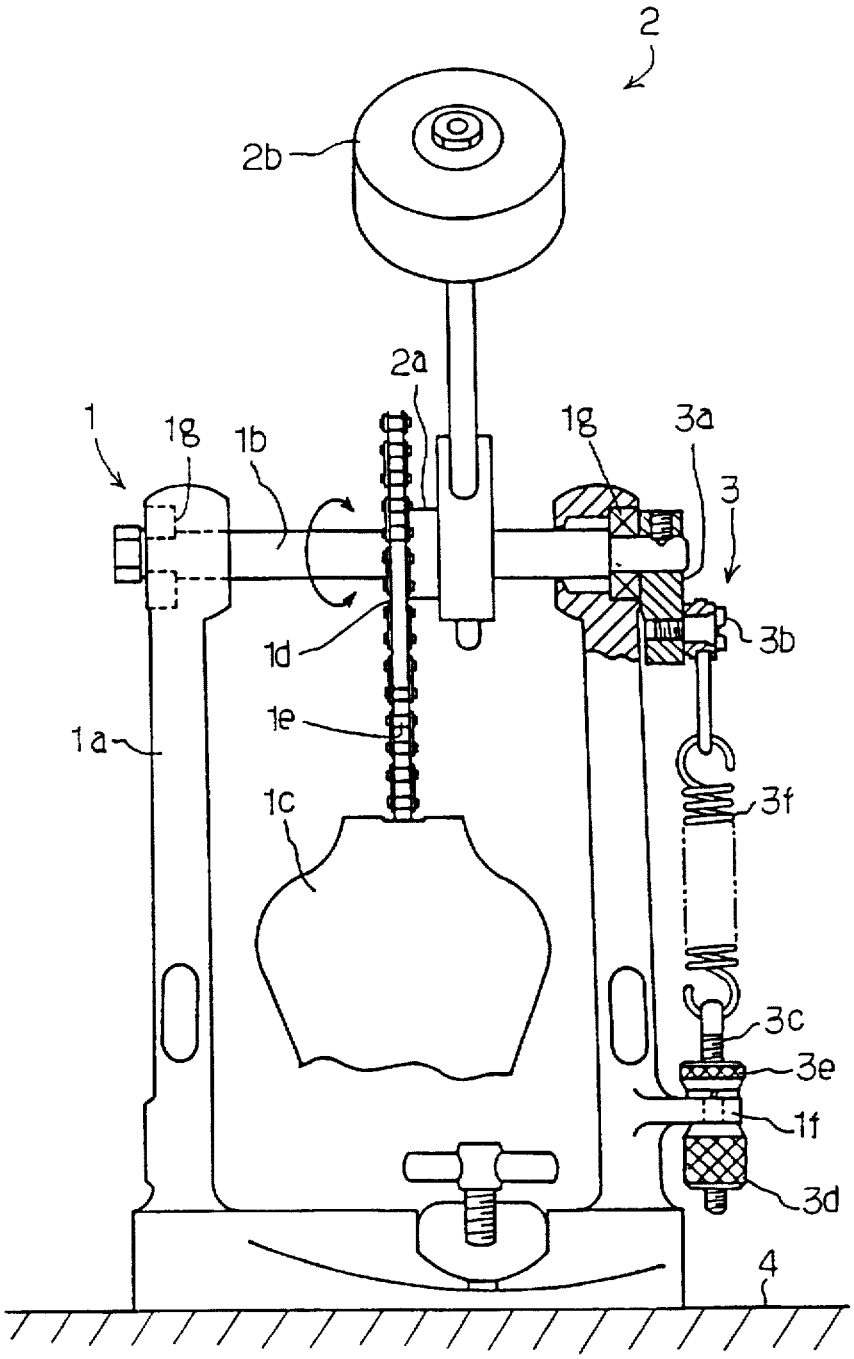
Fig. 1 PRIOR ART
FIG. 1 is a partially cut-away front view showing the structure of the prior art beater disclosed in Japanese Utility Model Publication of Examined Application Nos. 55-45433 and 58-43035.
Figure 2:
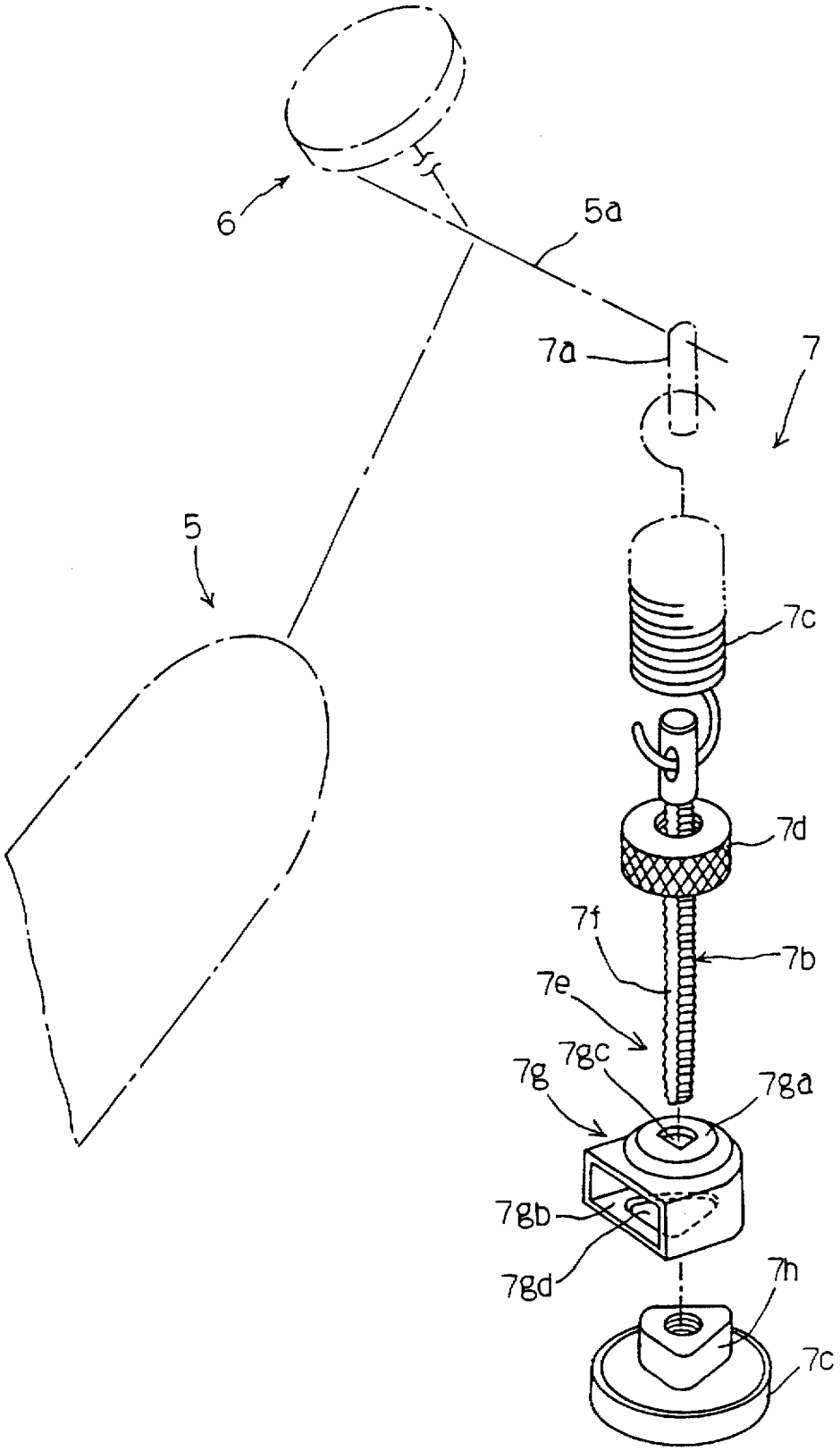
Fig. 2 PRIOR ART
FIG. 2 is a perspective view showing the righting moment generator incorporated in the prior art beater disclosed in Japanese Utility Model Publication of Unexamined Application No. 6-73795.
Figure 3:
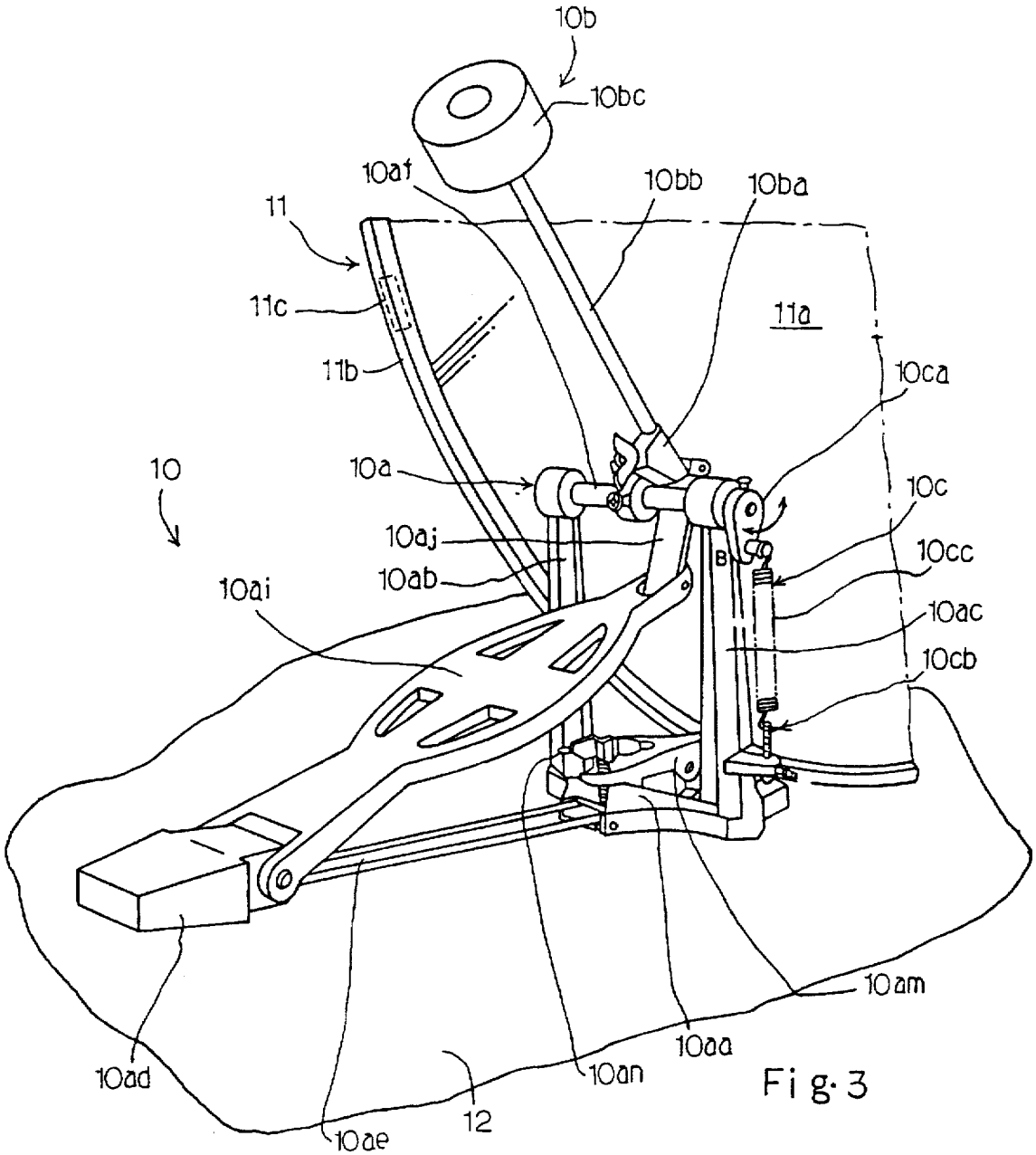
FIG. 3 is a perspective view showing the structure of a drum beater for a bass drum according to the present invention.
Figure 4:
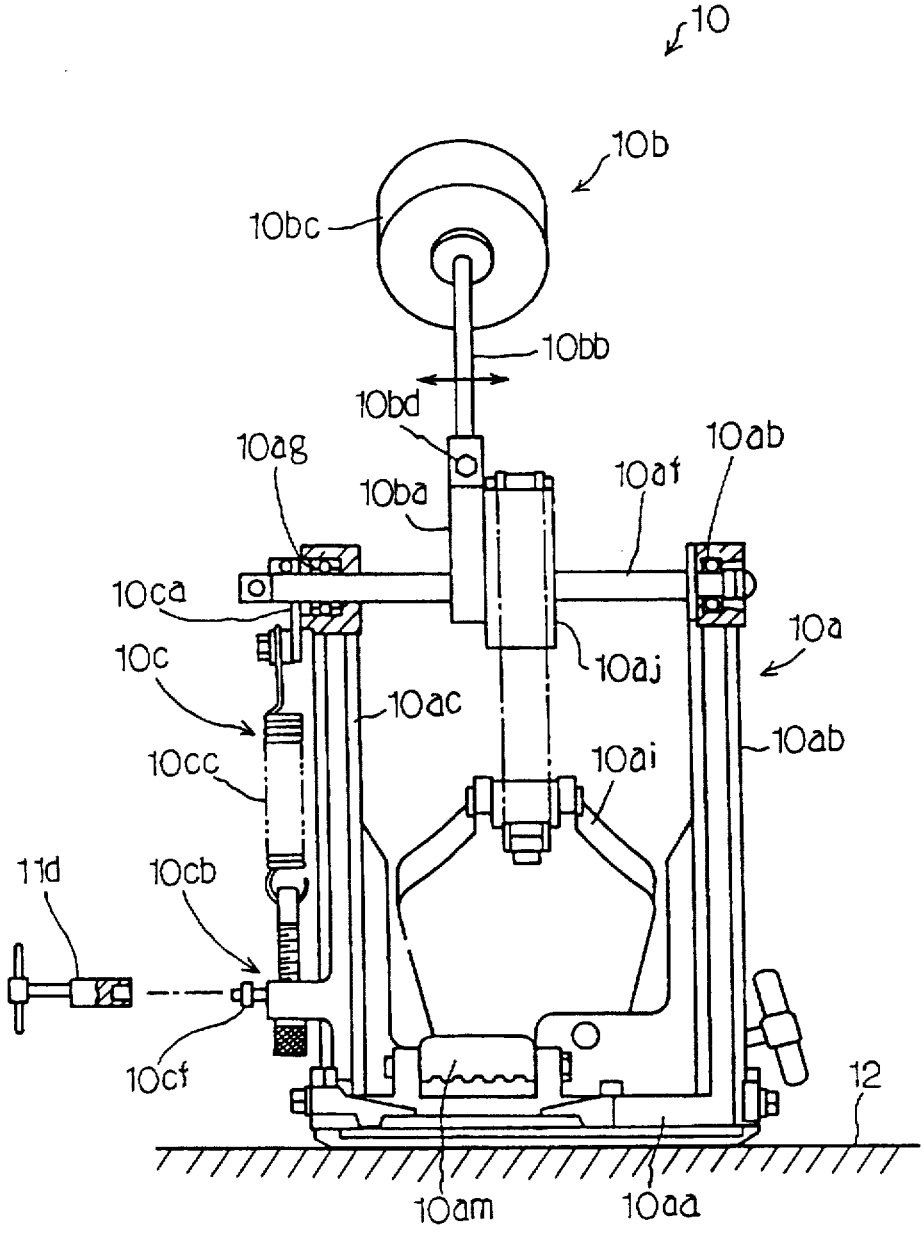
FIG. 4 is a front view showing the structure of the drum beater.
Figure 5:
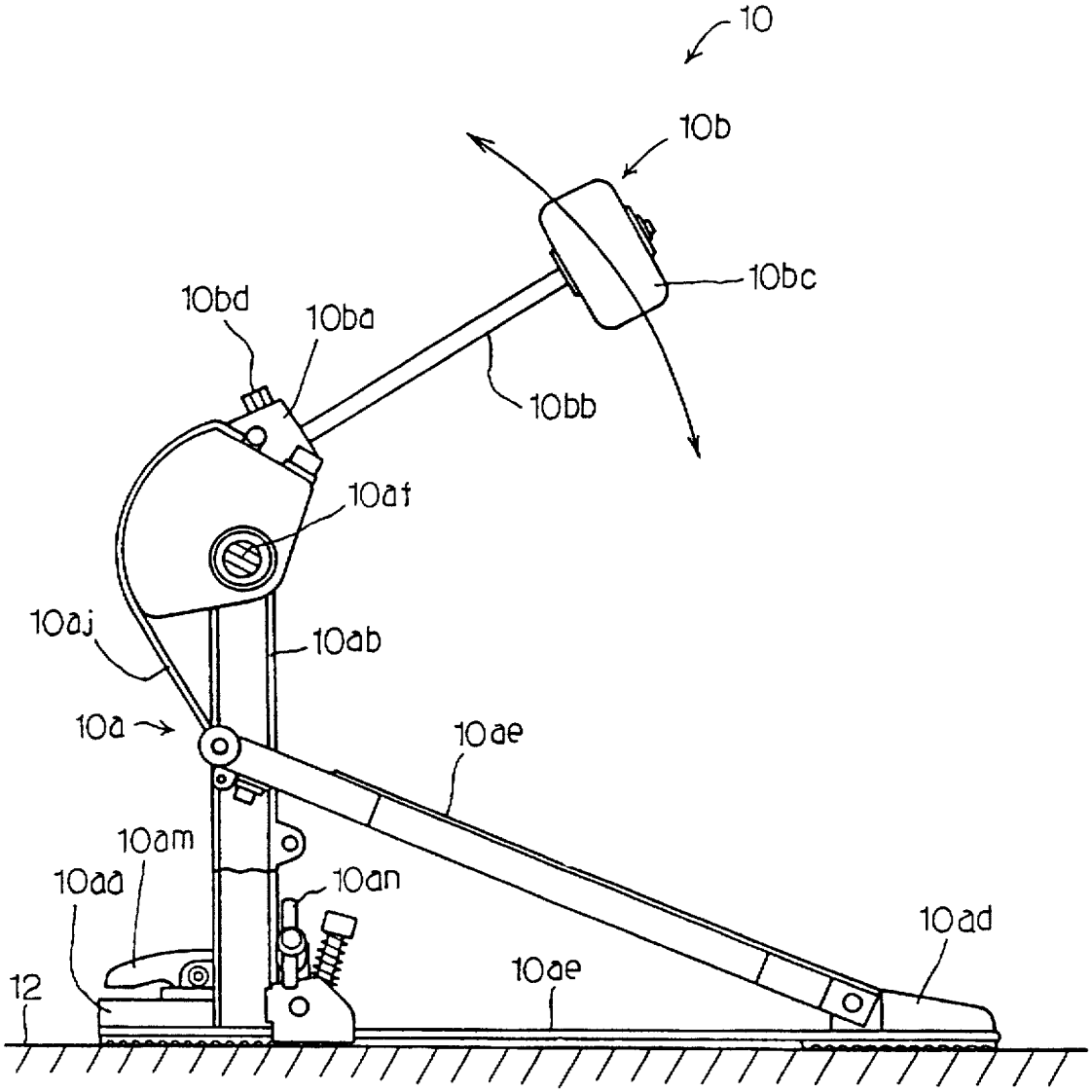
FIG. 5 is a partially cut-away side view showing the structure of the drum beater.

Referring to FIG. 3 of the present invention, a drum beater 10 embodying the present invention is placed in front of a skin 11*a* stretched over shell (not shown) of a bass drum 11. The skin 11*a* is fastened to the shell by means of a hoop 11*b*, and the hoop 11*b* is clamped with clamp bolts 11*c*. A player usually turns the clamp bolts 11*c* with a tuning key 11*d* (see FIG. 4). The drum beater 10 largely comprises a foot pedal assembly 10*a* placed on a floor 12, a beater 10*b* driven for rotation by the foot pedal assembly 10*a* and a righting moment generator 10*c* for regulating a righting moment.

The foot pedal assembly 10*a* includes a pedestal 10*aa* placed on the floor 12, a pair of post members 10*ab* and 10*ac* projecting on both sides of the pedestal 10*aa*, a heel spaced from the pedestal 10*aa* and a beam member 10*ae* connected between the pedestal 10*aa* and the heel 10*ad*. These members 10*aa* to 10*ae* as a whole constitute a frame structure, and Per se stands on the floor 12.

The foot pedal assembly 10*a* further includes a shaft member 10*af*, bearing units 10*ag*/10*ah* fixed to the leading ends of the post members 10*ab*/10*ac* for rotatably supporting the shaft member 10*af*, a foot board 10*ai* turnably connected to the heel 10*ad* and a connecting member 10*aj* connected between the foot board 10*ai* and the shaft member 10*af*. The foot board 10*ai* is wide enough to put a foot of a player thereon. When the player steps on the foot board 10*ai*, the foot board 10*ai* turns around the heel 10*ad*, and the connecting member 10*aj* converts the turning motion of the foot board 10*ai* to a rotation of the shaft member 10*af* around the bearing units 10*ag* and 10*ah*.

In this instance, the connecting member 10*aj* is formed from a leather strip or a flexible synthetic resin strip. A chain and a sprocket or a belt and a pulley are available for the connecting member 10*aj*.

The foot pedal assembly 10*a* further includes a clamp member 10*am* turnably supported by the pedestal 10*aa* and a clamp bolt 10*an* for pressing the clamp member 10*am* against the hoop 11*b*. The clamp member 10*am* grips the hoop 11*b*, and the clamp bolt 10*an* fixes the clamp member 10*am* to the hoop 11*b*.

The beater 10*b* is driven for rotation together with the shaft member 10*af*, and includes a rocking block 10*ba* fixed to the shaft member 10*af*, a beater rod 10*bb* projecting from the rocking block 10*ba* and a head 10*bc* attached to the leading end of the beater rod 10*bb*. Though not shown in the drawings, a hole is formed in the rocking block. The beater rod 10*bb* is inserted into the hole, and is fastened by means of a screw bolt 10*bd*. If the player loosens the screw bolt 10*bd*, the beater rod 10*bb* is slidable, and he can regulate the length from the rocking block 10*ba* and the head 10*bc*.

When no force is exerted on the foot board 10*ai*, the righting moment generator 10*c* exerts the righting moment on the shaft member 10*af*, and the righting moment spaces the head 10*bc* from the skin 11*a*.

When a player wants to beat the bass drum 11, he steps on the foot board 10*ai*, and rotates the shaft member 10*af* together with the beater 10*b*. The beater 10*b* strikes the skin 11*a*, and the skin 11*a* generates a drum sound. When the player releases the foot board 10*ai*, the righting moment rotates the shaft member 10*af* together with the beater 10*b*, and the head 10*bc* is spaced from the skin 11*a*.

The righting moment generator 10*c* imparts the righting moment to the shaft member 10*af*, and urges the beater 10*b* in the counter clockwise direction in the structure shown in FIG. 3. The righting moment generator 10*c* includes an arm member 10*ca* fixed to the shaft member 10*af*, a return spring regulator 10*cb* connected to the post member 10*ac* and a coil spring 10*cc* stretched between the arm member 10*ca* and the return spring regulator 10*cb*. A player varies the righting moment by using the return spring regulator 10*cb*.

Figure 6:
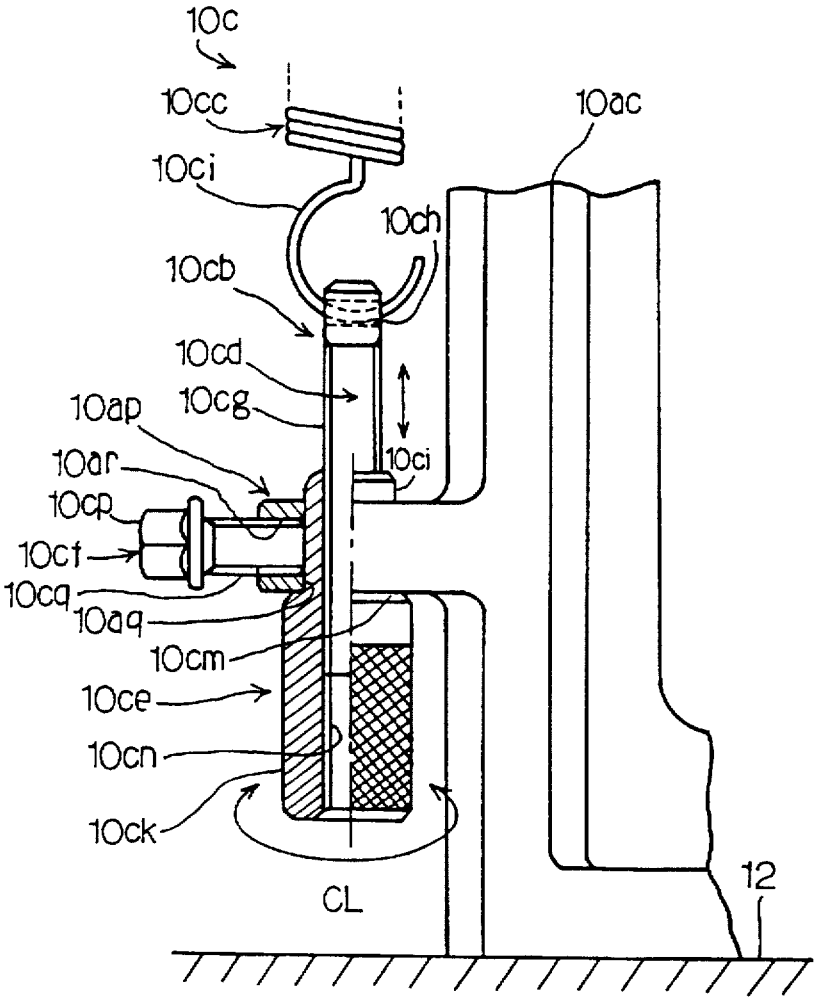
FIG. 6 is a partially sectional front view showing a return spring regulator incorporated in the drum beater shown in FIGS. 3 to 5.

As shown in FIG. 6 in detail, the return spring regulator 10*cb* has a regulating bolt 10*cd*, a regulating nut 10*ce* and a clamp bolt 10*cf*. The frame has a lug portion 10*ap* laterally projecting from the post member 10*ac*. A through-hole 10*aq* is formed in the lug portion 10*ap*, and extends in a vertical direction or a perpendicular direction to the floor 12. A lateral hole is further formed in the lug portion 10*ap*, and is open to the through-hole 10*aq*. The inner surface defining the lateral hole is threaded, and, accordingly, the plug portion 10*ap* has an inner threaded portion 10*ar*.

The outer surface of the regulating bolt 10*cd* is threaded along a center axis CL thereof, and, accordingly, the regulating bolt 10*cd* has an outer threaded portion 10*cg*. A lateral hole 10*ch* is formed in one end portion of the regulating bolt 10*cd*, and a hook 10*ci* of the coil spring 10*cc* is engaged through the lateral hole 10*ch* with the regulating bolt 10*cd*. For this reason, the coil spring 10*cc* upwardly urges the regulating bolt 10*cd*.

The regulating nut 10*ce* is largely broken down into a thin portion 10*ci* and a thick portion 10*ck* along the center axis thereof, and the outer surface of the thick portion 10*ck* is contiguous through a chamfer surface 10*cm* to the outer surface of the thin portion 10*ci*. The thin portion 10*ci* is roughly equal in diameter to the through-hole 10*aq*, and is loosely insertable into the through-hole 10*aq*. Accordingly, the thin portion 10*ci* is turnable in the through-hole 10*aq*. The thick portion 10*ck* is larger in diameter than the through-hole 10*aq*, and is never inserted into the through-hole 10*aq*. When the thin portion 10*ci* is inserted into the through-hole 10*aq*, the chamfer surface 10*cm* is brought into contact with the periphery defining the through-hole 10*aq*, and the thick portion 10*ck* projects under the lug portion 10*ap*.

The outer surface of the thick portion 10*ck* is roughened, and allows a person to turn the thick portion 10*ck* with his fingers.

A through-hole is formed in the regulating nut 10*ce* along the center axis thereof, and the inner surface defining the through-hole is threaded so that the regulating nut 10*ce* has an inner threaded portion 10*cn*. The outer threaded portion 10*cg* is engaged with the inner threaded portion 10*cn*, and the regulating bolt 10*cd* is screwed into the regulating nut 10*ce*.

The clamp bolt 10*cf* has a head portion 10*cp* and a threaded portion 10*cq*. The head portion 10*cp* has a cross section identical with the cross section of the head portion of each clamp bolt 11*c*. For this reason, a player can loosen and tighten the clamp bolt 10*cf* by means of the tuning key 11*d* used for the clamp bolts 11*c*. The outer threaded portion 10*cq* is engageable with the inner threaded portion 10*ap*, and the clamp bolt 10*cf* is screwed into the lateral hole. As described hereinbefore, the lateral hole is open to the through-hole 10*aq*, and, accordingly, the leading end of the clamp bolt 10*cf* is pressed against the outer surface of the thin portion 10*ci*. When the leading end is strongly pressed against the outer surface of the thin portion 10*ci*, a player hardly turns the regulating nut 10*ce*, and determines the tension of the coil spring 10*cc*.

Assuming now that a player wants to increase the righting moment, he loosens the clamp bolt 10*cf*, and turns the thick portion 10*ck* so as to downwardly move the regulating bolt 10*cd*. When the righting moment is adjusted, he stops the turn of the regulating nut 10*ce*, and screws the clamp bolt 10*cf* into the lateral hole. The leading end of the clamp bolt 10*cf* is pressed against the outer surface of the thin portion, and does not allow the regulating nut 10*ce* to turn.

On the other hand, when a player wants to decrease the righting moment, he loosens the clamp bolt 10*cf*, and turns the thick portion in the opposite direction. The regulating nut 10*ce* upwardly moves the regulating bolt 10*cd*, and the regulating bolt 10*cd* decreases the tension of the coil spring 10*cc*. After the regulation of the righting moment, he screws the clamp bolt 10*cf* into the lateral hole, and presses the leading end of the clamp bolt 10*cf* against the outer surface of the thin portion 10*ci*.

Thus, only three parts 10*cd*, 10*ce* and 10*cf* constitute the return spring regulator 10*cb*, and the return spring regulator 10*cb* is simpler than the prior art return spring regulators. The regulating bolt 10*cd*, the regulating nut 10*ce*, the clamp bolt 10*cf* and the lug portion 10*ap* are machined through a drill work and a threading work without a complicate machining work, and the production cost of the drum beater 11 is lower than the prior art drum beaters.

The regulating bolt 10*cd* is not partially cut away, and is durable.

The clamp bolt 10*cf* is moved with respect to the lug portion 10*ap* independently from the motion of the regulating bolt 10*cd* and the regulating nut 10*ce*, and the turning motion of the regulating nut 10*ce* does not affects the position of the clamp bolt 10*cf*. For this reason, the regulating work is easy. Finally, the clamp bolt 10*cf* does not change the position of the regulating bolt 10*cd*, and a player can exactly adjust the righting moment to an appropriate value.

The drum beater 10 behaves as follows. A player places the drum beater 10 in front of the bass drum 11, and connects the drum beater 10 and the hoop 11*b*. The player repeatedly steps on the foot board 10*ai* so see whether or not the righting moment is appropriate. If the foot board 10*ai* is too heavily or too light, he loosens the clamp bolt 10*cf* with the tuning key 11*d*, and regulates the tension of the coil spring 10*cc* as described hereinbefore. When the tension and, accordingly, the righting moment are appropriately regulated, he tightens the clamp bolt 10*cf*, again.

The player sits on a chair (not shown) in front of the bass drum 11, and places his foot on the foot board 10*ai*. He repeatedly depresses and releases the foot board 10*ai*. When he depresses the foot board 10*ai*, the foot board 10*ai* turns around the heel 10*ad*, and rotates the shaft member 10*af* against the righting moment. The coil spring 10*cc* is further stretched. The beater 10*b* is rotated from the home position toward the skin 11*a*, and strikes the skin 11*a*. The skin 11*a* vibrates, and generates the drum sound.

When he releases the foot board 10*ai*, the coil spring 10*cc* is shrunk, and imparts the righting moment to the shaft member 10*af*. The shaft member 10*af* and, accordingly, the beater 10*b* turn in the opposite direction, and the beater 10*b* returns to the home position. The connecting member 10*aj* transfers the righting moment to the foot board, and the foot board 10*ai* returns to the initial position.

As will be appreciated from the foregoing description, the drum beater 10 according to the present invention is simple in structure, low in production cost and easy for regulating the righting moment.

Although particular embodiments of the present invention have been shown and described, it will be obvious to those skilled in the art that various changes and modifications may be made without departing from the spirit and scope of the present invention. For example, the damper may be implemented by any kind of detent such as, for example, a ratchet and a pawl. The drum is not limited to the bass drum. The drum beater is available for any kind of drum.

What is claimed is:

1. A drum beater for a drum having a skin stretched over a shell, comprising:

a foot pedal assembly including a rotatable shaft and a foot board which a player steps on for rotating said rotatable shaft from a home position toward said skin;

a beater connected to said rotatable shaft for beating said skin; and a righting moment generating means connected to said rotatable shaft for urging said beater toward said home position, and including an arm member fixed to said rotatable shaft, a spring member connected at one end to said arm member and generating an elastic force for imparting a righting moment to said rotatable shaft and a spring regulator connected to the other end of said spring member so as to change said elastic force exerted to said arm member, said spring regulator including a regulating nut member having an inner threaded portion, a first portion rotatable inserted into a through-hole formed in said foot pedal assembly and a second portion larger in the maximum dimension of a cross section than said through-hole, a regulating bolt member connected to said other end of said spring member and having an outer threaded portion engaged with said inner threaded portion so as to be screwed into or out of said first portion and a clamper for preventing said first portion from rotating in said through-hole, said clamper being implemented by a first clamp bolt screwed into a threaded hole open to said through-hole, and a hoop retaining said skin on said shell by means of second clamp bolts, a tool being configured to engage said first clamp bolt and said second clamp bolts.

2. The drum beater as set forth in claim 1, in which said tool has a recess adapted to a head of said first clamp bolt and heads of said second clamp bolts.

* * * * *